US006568450B1

(12) United States Patent
Stevens

(10) Patent No.: US 6,568,450 B1
(45) Date of Patent: May 27, 2003

(54) TAPE DISPENSER

(75) Inventor: Christopher John Stevens, Reading (GB)

(73) Assignee: Berol Corporation, Freeport, IL (US)

( * ) Notice: Subject to any disclaimer, the term of this patent is extended or adjusted under 35 U.S.C. 154(b) by 0 days.

(21) Appl. No.: 09/039,829

(22) Filed: Mar. 16, 1998

Related U.S. Application Data

(63) Continuation of application No. PCT/US96/15569, filed on Sep. 27, 1996.

(30) Foreign Application Priority Data

Oct. 2, 1995 (GB) ..... 9520084

(51) Int. Cl.[7] ..... B32B 35/00; B65H 55/00

(52) U.S. Cl. ..... 156/540; 156/238; 156/486; 156/577; 156/579; 118/257; 118/76; 242/588.3; 242/588.2

(58) Field of Search ..... 156/579, 574, 156/577, 584, 540, 238, 247, 391, 486; 206/391; 242/588.2, 916, 588.3; 118/257, 76; 29/242; 15/144.1

(56) References Cited

U.S. PATENT DOCUMENTS 2,750,616 A * 6/1956 Klugman ..... 15/144.1
5,038,492 A * 8/1991 Bryant et al. ..... 33/758

FOREIGN PATENT DOCUMENTS

| | | |
|---|---|---|
| GB | 2275042 | 8/1994 |
| WO | 9221568 | 12/1992 |
| WO | 9500334 | 1/1995 |

* cited by examiner

*Primary Examiner*—Linda Gray
(74) *Attorney, Agent, or Firm*—Marshall, Gerstein & Borun

(57) ABSTRACT

The tape dispenser has a handle (1) for storing a supply of tape (18). The tape (18) consists of a backing ribbon carrying a coating composition, and backing ribbon from which the coating composition has been removed. An applicator (12) having en edge (10) around which the tape (18) passes is arranged for pressing the tape (18) against a surface to transfer the coating composition from the backing ribbon to said surface.

6 Claims, 3 Drawing Sheets

TAPE DISPENSER

This is a continuation of PCT/US96/15569, filed Sep. 27, 1996.

BACKGROUND OF THE INVENTION

This invention is concerned with tape dispensers of the kind used to apply a strip of a coating composition to a surface. The invention is described herein in relation to so-called correction tape dispensers which are used to lay down onto a paper surface a layer of thin material to cover a writing or typing mistake and hence facilitate correction of that mistake. However, the tape dispensers disclosed herein could be used for applying other coating layers to a surface. Tape dispensers have an applicator tip defining an edge around with the tape passes and which is used to press the tape against the paper surface. The tape consists of a backing ribbon, e.g. of paper or plastics, which carries on one side a continuous layer of the coating composition. When the tape is pressed against the paper surface by the applicator edge and the edge is caused to move over the surface fresh tape is drawn from a supply of tape contained within a body of the dispenser, as the tape passes around the edge the coating composition is transferred from the backing ribbon to the paper surface so that a continuous strip of composition is deposited onto the paper, and the spent ribbon from which the coating composition has been removed is drawn back into the dispenser body for storage until the entire supply of tape has been consumed when the used ribbon, or possibly the entire dispenser is discarded. The body of the dispenser forms a handle by means of which the dispenser is gripped in the hand by the user.

Due to their overall shapes and configurations, many correction tape dispensers are awkward to hold in use. In our prior patent No. GB 2275042 there is described a tape dispenser with a tape guidance arrangement enabling the dispenser handle to be so orientated relative to the applicator edge that the handle can be held in use in similar manner to the way in which a writing instrument is normally held. Thus, in use the dispenser handle can extend upwardly away from the paper in a direction inclined generally towards the user. This configuration makes the dispenser convenient and easy to use, but it has a drawback in that it is "handed", meaning that a dispenser intended to be used while held in the right hand cannot be easily used while held in the left hand.

SUMMARY OF THE INVENTION

The present invention addresses this problem and as a solution it provides a tape dispenser comprising a handle within which are means for storing a supply of tape consisting of a backing ribbon carrying a coating composition, and backing ribbon from which the coating composition has been removed, an applicator with an edge around which the tape passes and arranged for pressing the tape against a surface to transfer the coating composition from the backing ribbon to said surface, the handle being coupled to the applicator to permit selective adjustment of the handle relative to the applicator edge between positions inclined in opposite directions with respect to a plane normal to the edge.

Most conveniently the handle is pivotally adjustable relative to the applicator between the positions which are most suitable for left hand and right hand use. A detent mechanism may be provided to retain the handle in the selected adjustment position during normal use, so that the user is not required to take special steps, such as tightening any parts, to secure the handle position.

In a presently preferred embodiment the detent mechanism is in the general form of a ratchet enabling the handle to be adjusted to any of several positions. In addition to enabling the dispenser to be configured to facilitate left or right hand use, this has the advantage of allowing the user to select a range of handle inclinations according to personal preference for convenience and comfort in use.

Because the handle is adjustable the areas from which the tape is fed to the applicator and to which the spent backing tape is delivered from the applicator, are not predetermined. The tape guide means are therefore preferably arranged to guide the tape through a position substantially coincident with the axis about which the handle is adjustable relative to the applicator. In this way the tape can be guided between the applicator edge and a position which is fixed relative thereto irrespective of the adjusted position of the handle.

Conveniently the tape guiding means comprises a pair of cylindrical rollers with their rotational axes parallel to the pivot axis and their surfaces spaced apart sufficiently to enable the tape to run freely between them.

BRIEF DESCRIPTION OF THE DRAWINGS

A complete understanding of the invention will be gained from the following detailed description of an exemplary embodiment, reference being made to the accompanying drawings, in which.

DETAILED DESCRIPTION OF THE BEST MODE

Figure 1:
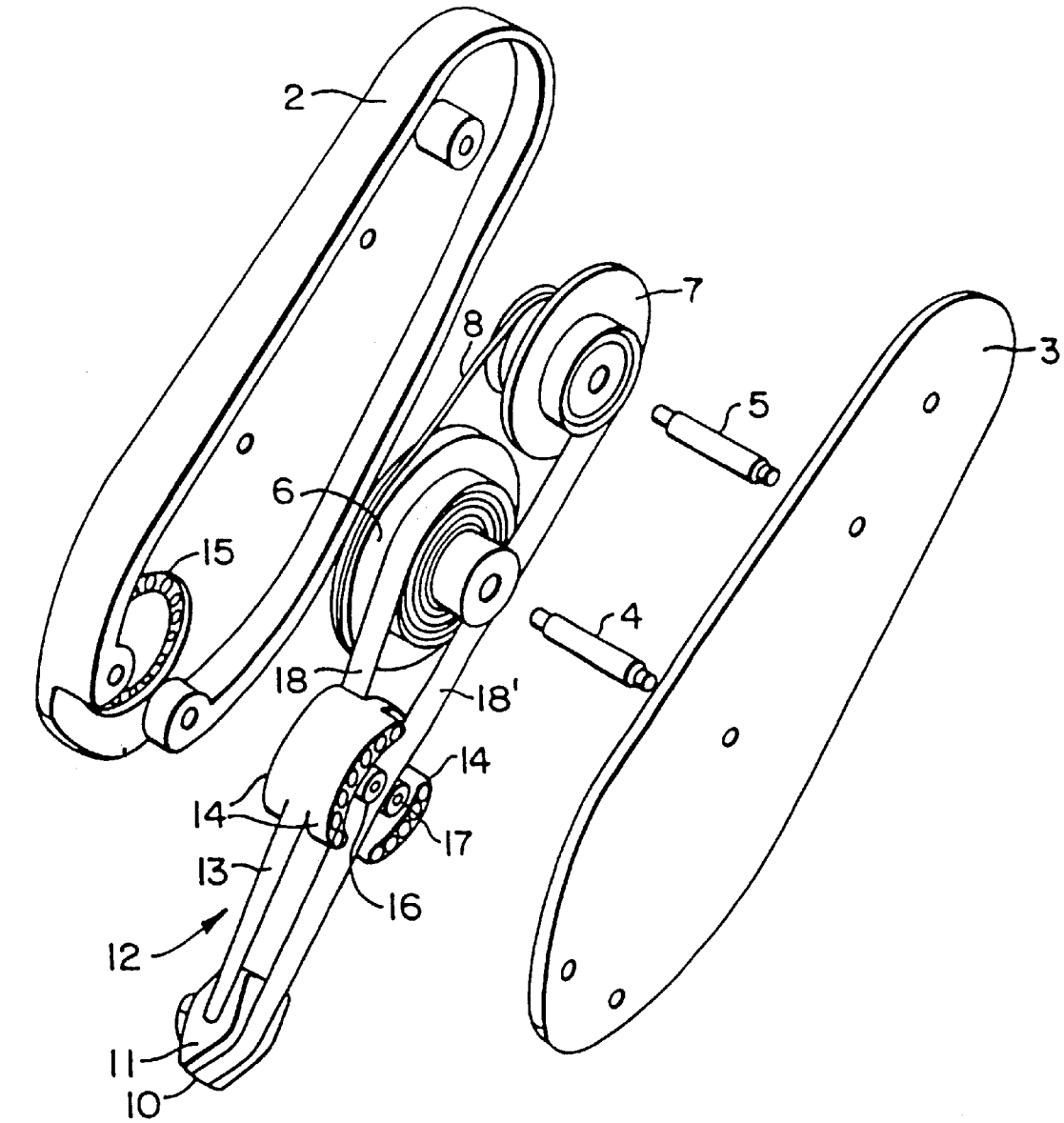
FIG. 1 is an exploded perspective view of a correction tape dispenser in accordance with the invention.
Figure 2:
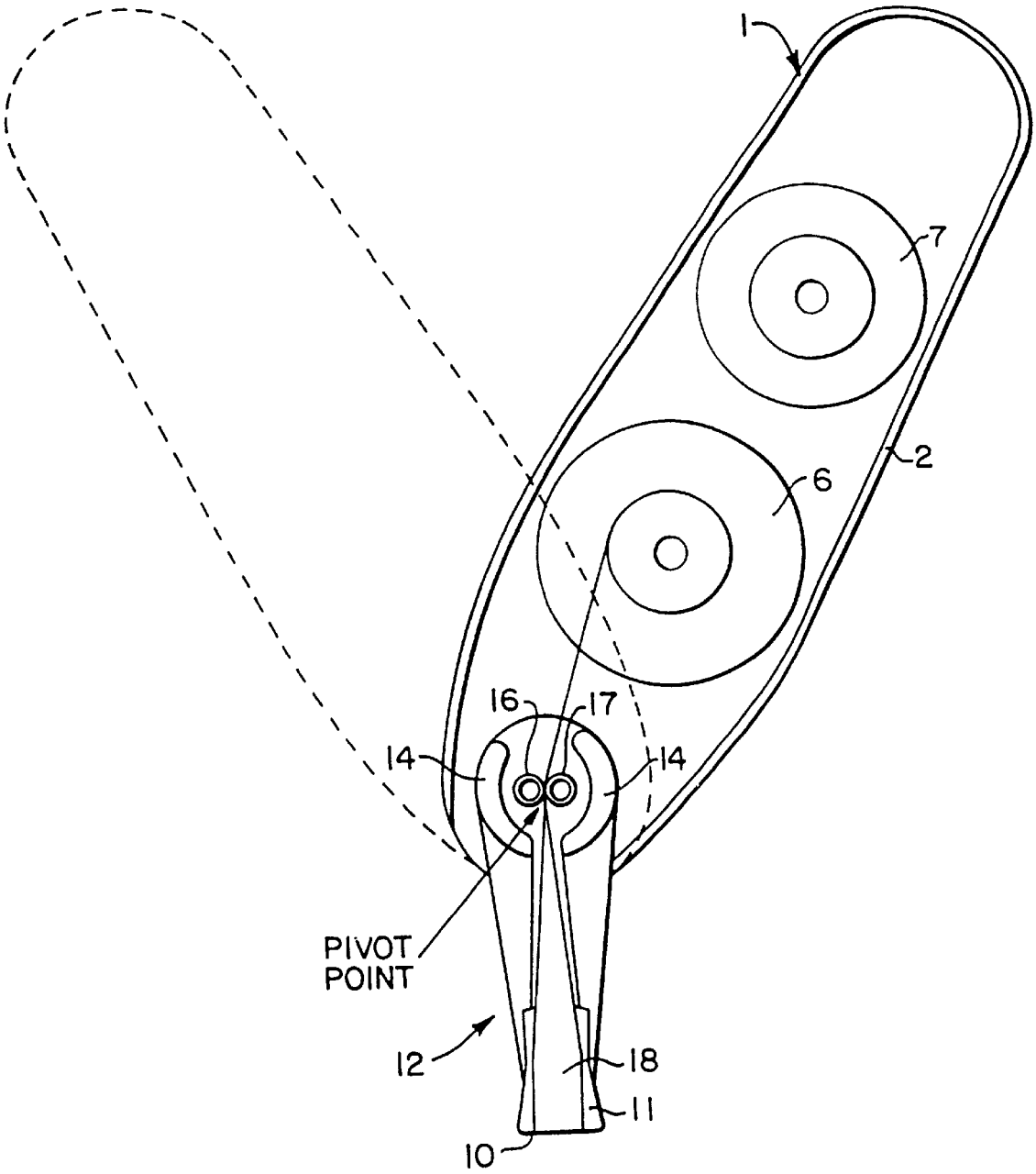
FIG. 2 is a schematic side view with the cover of the handle casing removed.

The illustrated tape dispenser comprises a body or handle 1 including a casing assembled from a base part 2 and a cover 3 secured together by fasteners, welding or by any other convenient means. Mounted within the casing are a pair of transverse spindles 4,5 supported between the base and cover and carrying respectively a supply spool 6 and a take up spool 7. The spools include integral pulleys around which a continuous drive belt 8 is trained so that as fresh correction tape is drawn from the supply spool 6, the take up spool 7 is rotated to wind up the used backing ribbon. Between the two spools a section of tape is guided to pass out of the casing, around an operative edge 10 of an applicator 12 which projects from the casing, and back into the casing. The applicator has an arm 13 carrying a tip 11 which defines the edge 10, and the tip may be fixed on the arm or may be movably mounted to it to facilitate application of the correction composition to a surface, for example as described in our WO 95/00334 Patent. The inner end of the arm carries part-cylindrical shell bearing elements 14 which are arranged to journal in circular recesses 15 provided on the inner surfaces of the base and cover of the casing so that the applicator and handle are relatively pivotable. The confronting faces of the bearing elements and the casing journal recesses are formed with complementary detents, such as a series of pips around one face and a series of depressions around the other face, to form a ratchet system enabling the applicator 12 to be adjusted to any one of several positions between two extreme pivotal positions which are defined by the edges of the casing opening through which the applicator arm 13 protrudes. As best seen in FIG. 2 the handle is adjustable to extend in directions inclined oppositely relative to a plane P normal to the edge 10.

Carried on each side of the applicator arm within the confines of the bearing elements is a pair of rotatable guide rollers 16,17 which are located opposite each other with respect to the pivot axis of the casing 1 and applicator 12. The roller surfaces are spaced at a small distance apart to enable the tape to run freely between them. Thus, from the supply spool the tape 18 consisting of the backing ribbon and correction composition passes through a position coincident with the pivotal axis and defined by the pair of guide rollers 16,17 on one side of the applicator arm, passes to and around edge 10 of the applicator tip 11, passes back to a position coincident with the pivotal axis and defined by the pair of guide rollers 16,17 on the other side of the applicator arm, and then passes to the take up spool 7. In use the dispenser is held by the casing or handle, the edge 10 of the applicator tip is used to press the tape 18 against the paper surface, and the edge is caused to move across the surface in a direction substantially perpendicular to the edge. The correction composition becomes transferred from the backing ribbon to the paper surface, as the tip moves fresh tape being drawn from the supply spool 6 and backing ribbon 18' having passed around the tip edge and having therefore had the correction composition removed therefrom is wound up on the take up spool 7. In this way the correction composition is applied to the paper surfaces as a continuous strip 19 (FIGS. 3 and 4).

Figure 4:
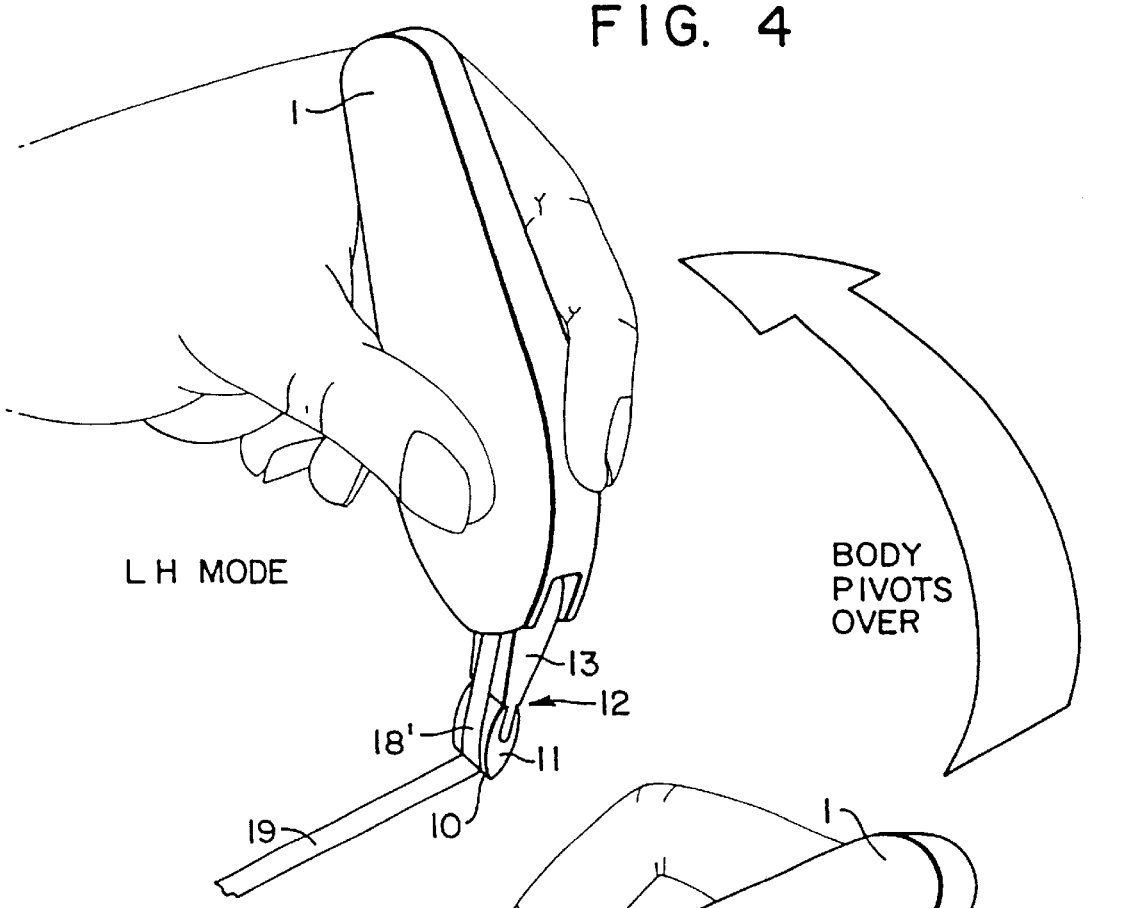
FIG. 4 illustrates the dispenser adjusted for left hand use.
Figure 3:
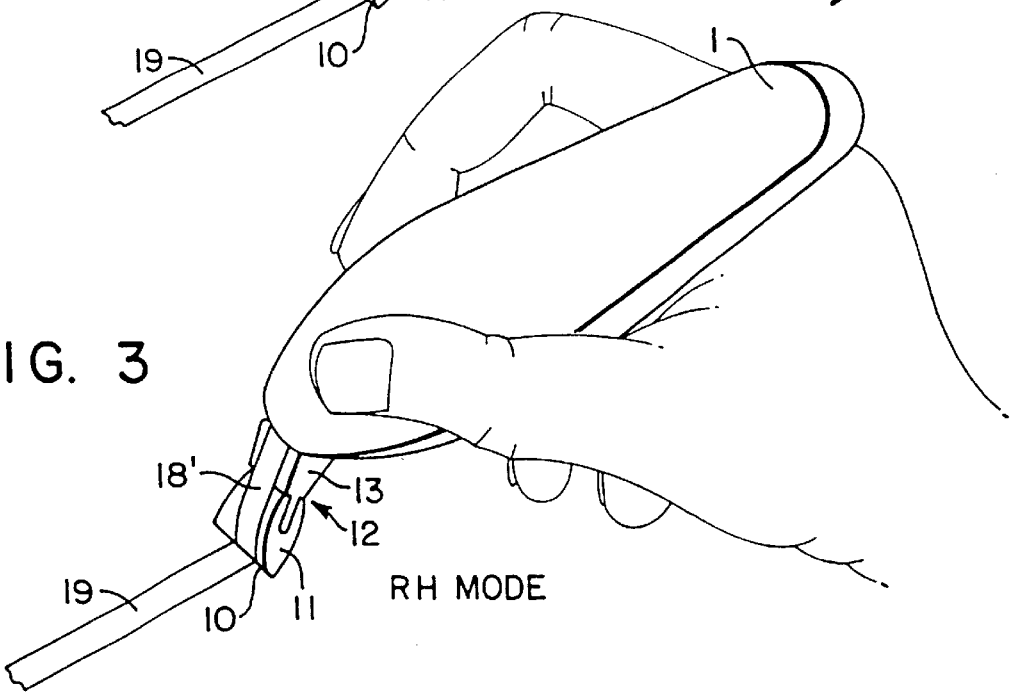
FIG. 3 illustrates the dispenser adjusted for right hand use.

The pivotal adjustment permitted between the applicator 12 and the handle 1 allows the handle to be readily adjusted from a position facilitating use by a right handed person, as shown in FIG. 3, to a position facilitating use by a left handed person as shown in FIG. 4. Furthermore, due to the ratchet system, the angle at which the handle needs to be held relative to the paper can be adjusted for maximum comfort by both left and right handed persons.

It will be appreciated that modifications to the described tape dispenser are possible without departing from the inventive concept. For example it may be mentioned that in place of the guide rollers 16,17 low friction guide pins could be used. Also, the pivotal adjustment between the handle and applicator may allow selection of just a few positions with the tip 11 being moveable to cater for finer adjustments of the handle position in use.

What is claimed is:

1. A tape dispenser comprising a handle within which are means for storing both an unused supply of tape and a used backing ribbon of the tape, and an applicator with an edge around which the tape passes, the applicator being arranged for pressing the tape against a surface to transfer a coating composition of the tape from the backing ribbon to said surface, the handle being coupled to the applicator to permit selective adjustment of the handle relative to the applicator edge between positions inclined in opposite directions with respect to a plane normal to the edge, wherein detent means are provided for retaining the handle in the selected adjustment position.

2. A tape dispenser according to claim 1, wherein the handle is pivotally adjustable relative to the applicator between said positions.

3. A tape dispenser according to claim 1, wherein the detent means includes ratchet means which are provided between the applicator and handle to enable the handle to be adjusted to any one of several positions of adjustment.

4. A tape dispenser according to claim 1, wherein the applicator has a bearing portion defining a pivot axis about which the handle is adjustable, and tape guide means for guiding the tape through a position substantially coincident with the pivot axis whatever the selected handle position.

5. A tape dispenser according to claim 4, wherein the tape guide means comprises a pair of members with tape contacting surfaces parallel to the pivot axis.

6. A tape dispenser according to claim 5, wherein the tape guide members are rollers.

* * * * *

UNITED STATES PATENT AND TRADEMARK OFFICE

CERTIFICATE OF CORRECTION

PATENT NO. : 6,568,450 B1
DATED : May 27, 2003
INVENTOR(S) : Christopher J. Stevens It is certified that error appears in the above-identified patent and that said Letters Patent is hereby corrected as shown below:

Title page,
Item [57], ABSTRACT, please replace with the following paragraph:
-- A tape dispenser has a handle for storing a supply of tape. The tape includes a backing ribbon carrying a coating composition, and backing ribbon from which the coating composition has been removed. An applicator having an edge around which the tape passes is arranged for pressing the tape against a surface to transfer the coating composition from the backing ribbon to surface. --.

Signed and Sealed this

Eighth Day of November, 2005

JON W. DUDAS
*Director of the United States Patent and Trademark Office*